United States Patent [19]

Romanoff

[11] 4,031,573

[45] June 28, 1977

[54] PORTABLE SAUNA

[76] Inventor: Paul Ira Romanoff, 4602 Collwood Lane, San Diego, Calif. 92115

[22] Filed: Sept. 17, 1976

[21] Appl. No.: 724,750

[52] U.S. Cl. ..... 4/164; 128/367

[51] Int. Cl.[2] ..... A61H 33/06

[58] Field of Search ..... 4/164, 160, 163, 165; 128/66, 367, 364

[56] References Cited

UNITED STATES PATENTS

| | | | |
|---|---|---|---|
| 664,282 | 12/1900 | Merker | 4/164 |
| 1,464,093 | 8/1923 | Friedlander | 4/164 |
| 2,551,552 | 5/1951 | Wahl | 4/164 |
| 2,725,577 | 12/1955 | Howard | 4/164 |
| 3,092,843 | 6/1963 | Wright | 4/164 |
| 3,351,956 | 11/1967 | Thoner | 4/164 |
| 3,351,957 | 11/1967 | Ikeda | 4/164 |
| 3,581,315 | 6/1971 | Milliner | 4/164 |
| 3,649,971 | 3/1972 | Basa | 4/164 |
| 3,875,596 | 4/1975 | Noda | 4/164 |

*Primary Examiner*—Henry K. Artis
*Attorney, Agent, or Firm*—Brown & Martin

[57] ABSTRACT

A portable hot air and steam bath includes a substantially rigid box-like structure having a deep section for extending vertically for defining the back of the apparatus and a hinged front section for hinging downward to define a floor of the apparatus with a cover of flexible material spanning the opening of the box and defining a substantially triangular shaped chamber in which is disposed a seat which automatically folds downward with the opening of the box, a heating apparatus for supplying either dry heat or steam, a control panel disposed upward and to the right of the seat for controlling the heating apparatus, a neck opening in the upper portion of the flexible cover to permit the head of an individual to protrude from the chamber, and a large opening securable by a zipper in the flexible cover for permitting entry and exit from the chamber.

10 Claims, 5 Drawing Figures

PORTABLE SAUNA

BACKGROUND OF THE INVENTION

The present invention relates generally to baths and pertains particularly to a collapsible self-contained combined sauna and steam bath assembly.

Portable collapsible saunas are well known in the arts. These have many advantages over the stationary kind, such as portability and ease of use in remote locations, quick and convenient set up and use, etc. One important advantage is that they can be constructed to permit the bather to breathe fresh and unheated air while taking his bath.

The prior known portable collapsible baths, however, have numerous drawbacks. Among these drawbacks are a lack of ruggedness and portability. For example, many of such devices are not completely self-contained and at the same time foldable into a convenient package for carrying. Also, many of such devices which are sufficiently rugged to withstand repeated use are not readily foldable into a convenient and light weight package for ease of carrying.

Other such devices include a complicated assortment of support structure and covering which is not readily assembled into its usable condition.

Other deficiencies of such prior art devices are lack of complete control by the operator over the heating assembly from his position within the bath.

It is therefore desirable that there be provided a portable collapsible combination sauna and steam bath that is both rugged and convenient to use and is collapisble and foldable into a compact structure for ease of carrying.

SUMMARY OF THE INVENTION

It is the primary object of the present invention to overcome the above problems of the prior art by providing a compact collapsible combination sauna and steam bath that is both compact and rugged and is easy to use.

Another object of the present invention is to provide a compact and portable combined sauna and steam bath that is entirely self-contained and that is easy and convenient to set up and use.

A further object of the present invention is to provide a compact and portable completely self-contained bath apparatus that is contained within a suitcase-like package for ease of transportability.

In accordance with the primary aspect of the present invention, a collapsible and portable hot air and steam bath apparatus includes means defining a substantially rigid bath wall and floor hinged together and including a flexible covering defining a substantially triangular shaped chamber, including a seat, a heating unit, and control means for the heating unit conveniently located within the chamber.

BRIEF DESCRIPTION OF THE DRAWING

The above and other objects and advantages of the present invention will become apparent from the following description when read in conjunction with the drawings wherein.

DETAILED DESCRIPTION OF THE PREFERRED EMBODIMENT

Figure 1:
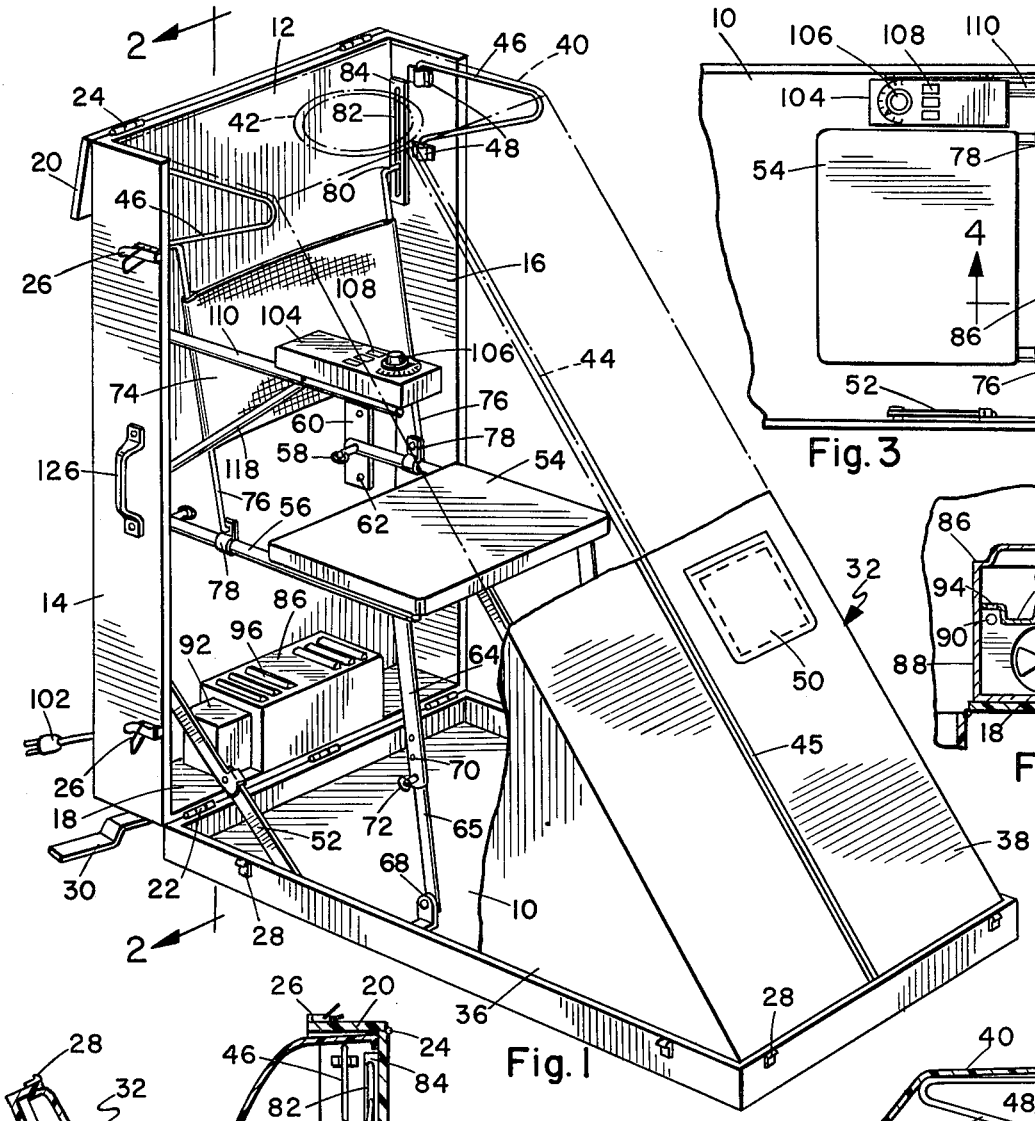
FIG. 1 is a perspective view of the unit set up for use, a portion of the cover being indicated in phantom.
Figure 3:
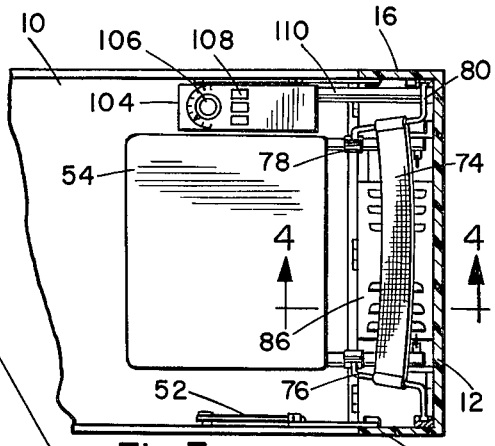
FIG. 3 is a sectional view taken on line 3—3 of FIG. 2.

Turning now to the drawings and particularly to FIG. 1, there is illustrated a perspective view of the unit in accordance with the present invention set up for use. The apparatus, as illustrated, comprises a box-like substantially rigid body structure comprising essentially a rather deep narrow box having a small rectangular cross section and defined by a front panel or section 10, a back panel or section 12 and side panels 14 and 16 and further having a bottom 18 and a top 20. The front panel 10 is hinged by a plurality of hinges 22 to the bottom panel 18.

The front panel 10 hinges downward, as shown in FIG. 1, from the remainder of the box portion and defines a floor of the apparatus. The back section or panel 12 and the side panels 14 and 16 extend vertically as shown to define a back wall and portions of a side wall respectively. This provides the basic frame work or support structure of the apparatus. The top panel 20 is suitably connected by a plurality of hinges 24 to the back panel 12 and hinges backward as shown to provide access to the interior of the box and neck opening in the covering as will be explained later.

Figure 5:
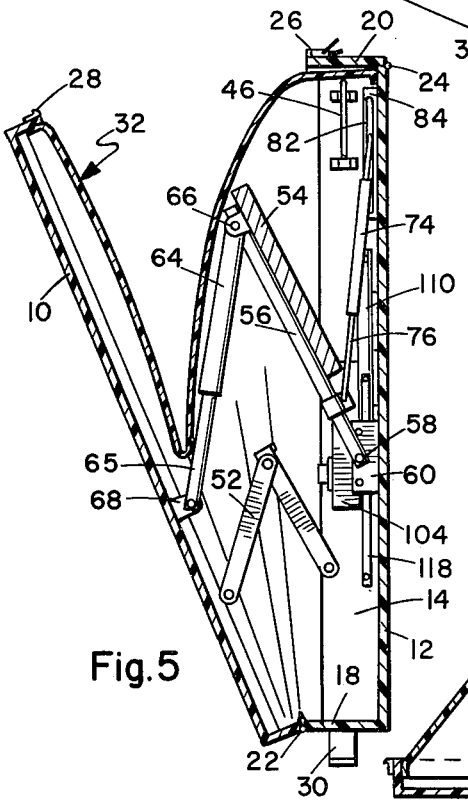
FIG. 5 is a sectional view similar to FIG. 2, but with the unit partially folded.

The box-like structure when in the closed position, as partially shown in FIG. 5, is held in that position by suitable latch means such as a plurality of luggage type latches 26 engaging a plurality of latch lugs 28 on the front panel 10.

Suitable retractable support feet or the like 30 are provided for supporting the back wall section at a level in conformance with the location of the floor defined by panel 10. This is best illustrated for example, in FIGS. 1 and 2.

Figure 2:
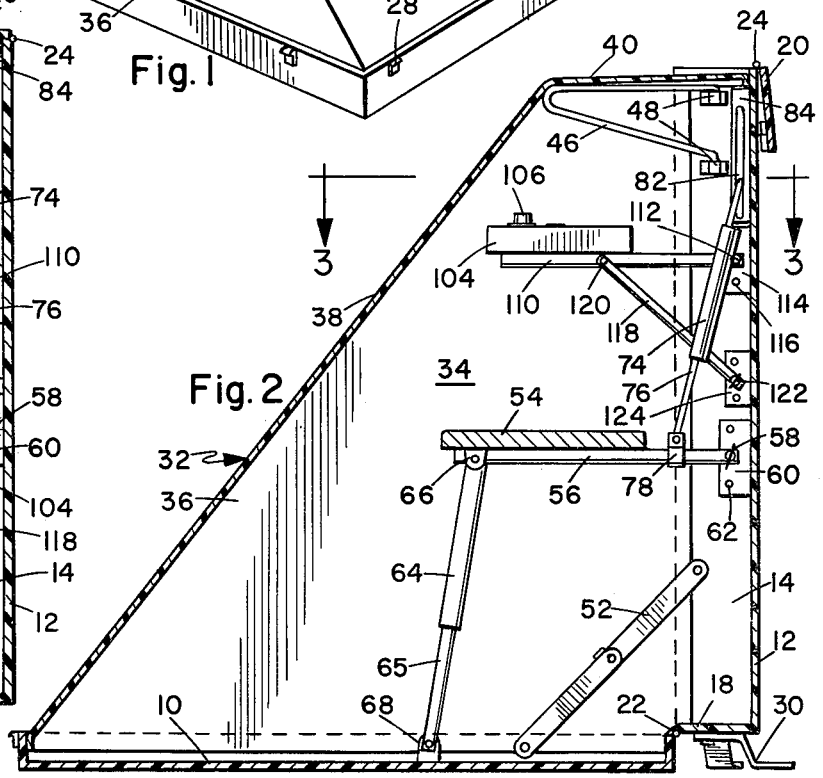
FIG. 2 is a sectional view taken on line 2—2 of FIG. 1.

A flexible cover made of any suitable flexible material, such as plastic or fabric, generally designated by the numeral 32, covers the opening between the two box-like sections. When in the open position, as best shown in FIGS. 1 and 2, the covered area defines a substantially triangular shaped bathing chamber or compartment designated generally by the numeral 34. This cover comprises a pair of generally triangular shaped side panels 36, only one of which is shown, a generally rectangular sloping front panel 38 and a generally horizontally extending top panel 40. These panels are secured in a suitable manner along their edges to the edges of the front panel 10, the side panels 14 and 16, and the back panel 12 to define the complete enclosure.

The cover includes a neck opening 42 formed in the top panel 12 and a longitudinal opening defined by slit 44 running from the neck opening 42 downward to the base of the front panel. This slit is closable by suitable means such as a zipper 45, which can be opened from either inside or outside. This provides an opening for entrance into the chamber of the apparatus and for exiting therefrom.

A pair of arms 46 are pivotally mounted in vertically disposed brackets 48 on side panels 14 and 16 for pivoting outward as shown in FIG. 1 and FIG. 2 for supporting the upper panel 40 of the cover in the outward horizontal position as shown in FIGS. 1 and 2. These arms 46 are pivotal about a vertical axis defined by the brackets 48 inward to a position as shown in FIG. 5 to permit closing of the apparatus as illustrated therein.

A flap opening 50 is provided in the ftont panel 38 to permit selective venting of the chamber 34. The flap may include simple fastening means not shown or simply permitted to close by virtue of the weight thereof as illustrated. A suitable strap brace 52 is provided between the front and back panels or the front panel 10 and the remainder of the box section to retain the back panel in the vertical position relative to the front panel when in the open position as shown in FIGS. 1 and 2. This strap brace is hinged in the center as shown to permit folding up of the apparatus, as shown in FIG. 5.

A suitable folding seat arrangement is provided in the apparatus and connected to the front and back panels such that the seat automatically folds up and folds out with the folding and unfolding of the apparatus. The seat assembly includes a substantially rectangular flat seating member 54 supported on a pair of parallel disposed pivotally mounted support bars or rods 56 which are pivotally secured by means of detachable pins 58 to brackets 60. The brackets 60 include a plurality of pin receiving holes 62 positioned at the various levels vertically with respect to the floor to permit vertical adjustment of the seat. The pins 58 are preferably of the frictional ball retainer type, such that they merely need be pulled out and pushed back in and are retained in their position by frictional balls. A pair of adjustable legs or struts 64 are pivoted at their upper ends to brackets 66 secured either to seat 54 or to the support rods or bars 56. The adjustable legs 64 are also pivotally connected to the lower end by bracket means 68 to the front panel 10. As best seen in FIG. 1, the legs comprise outer and inner telescoping members 64 and 65 and having a plurality of transverse holes 70 in which are disposed a frictional pull pin 72 for adjusting the length of the leg to correspond to the proper elevation of the seat member 54.

This assembly also includes a suitable back rest or support member 74 strung between a pair of substantially vertically extending support rods 76, which are received in tubular sleeves in the ends of the rectangular back member 74. The support rods 76 are pivotally connected at their lower ends to a bracket 78 secured to the horizontal support bars 56 and include a laterally extending pin portion 80 at the upper end engaging a slot 82 in a suitable bracket 84 secured to side panels 14 and 16.

This seating assembly permits the seat portion 54 to be adjusted vertically to accommodate various size individuals. This will, of course, be required in order to permit the individual to sit comfortably with his neck received in the neck opening 42 and the head extending thereabove. The seat assembly is also constructed and arranged to automatically fold up with the apparatus as shown in FIG. 5 without special attention thereto.

Figure 4:
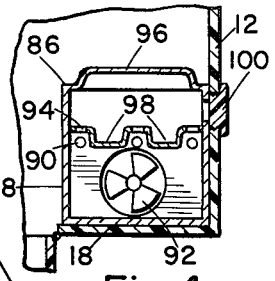
FIG. 4 is an enlarged fragmentary sectional view taken on line 4—4 of FIG. 3.

Suitable heating means, such as heating unit 86, is mounted within the unit such as to the bottom panel 18 for generating and conducting heat to the interior of the chamber 34. The heating unit may be in any suitable form, but for the purpose of convenience and versatility comprises preferably an electrical heater which as best illustrated in FIG. 4 includes a housing 88 defining a compartment in which is disposed or suitably mounted a plurality of heating elements 90 for receiving current from a suitable electrical source and converting it to heat. A suitable circulating fan 92 is provided for drawing air in, or circulating air through the chamber and out by way of a plurality of openings 94 where it is conveyed by a plurality of louvers 96 in the outer housing 88.

The heating unit includes a pair of heating pans or trays 98 which are fillable by means of a plug 100 externally of the unit for generating steam. Thus, for the sauna effect or dry heat, the trays 98 are left empty and dry heat is circulated within the chamber 34. However, when steam heat is desired the trays 98 are filled with water and the resulting heating thereof creates steam which is circulated within the compartment 34. This provides the alternate or selectability of dry or steam heat. The heating unit is connectable by a suitable source or by suitable means such as an electrical cord 102 with a suitable plug to a suitable electrical outlet in a well known manner.

The heating means is controlled by a suitable heat control panel 104 connected in a suitably well known manner to control the heating unit 86. The control panel includes a timer 106 for turning on and controlling the time interval during which the heating means 86 will operate. A plurality of push buttons 108 select the preferred heat setting, thus providing a range of temperatures.

The control panel 104 is mounted on a suitable support arm 110 which is pivotally mounted by a suitable pin 112 to a bracket 114 having a plurality of pin holes 116 for adjusting the height of the control panel. An adjustable brace 118 is likewise pivotally mounted at one end 120 to the support arm 110 and at the opposite end by a suitable frictional pin 122 to a bracket 124. This permits the control panel 104 to be vertically adjustable to be convenient to be manipulated by the bather while encompassed within the compartment 34. The control panel is vertically adjustable with the seat or in a similar manner as the seat 54. A suitable luggage type hand grip or handle 126 is provided for ease of carrying.

The above described apparatus as will be appreciated is an entirely self-contained unit containing all of the components necessary for defining the complete steam or sauna bath. The only limitation is the necessity for convenient outlet for a source of electrical power for powering the heater unit. In a similar manner, a source of water for filling the tray 98 must also be available if the steam heat is desirable. Otherwise, the unit is completely self-contained including all components thereof suitably arranged and interconnected to require merely the folding out of the apparatus if, for example, when it is in a completely collapsed state. The apparatus is conveniently packaged within a compact and convenient package for ease in carrying In order to set up the apparatus, it is rested on the floor on its vertical end in its vertical arrangement as is shown in FIG. 1. The latches 26 are released and the front panel permitted to fold downward as shown in FIG. 5 to the downward position as shown in FIGS. 1 and 2. As the front panel folds downward, the cover 32 will likewise fold outward and the seat 54 will simultaneously fold downward with the front panel 10. Once the front panel has been folded downward, the strap brace 52 will be secured to retain the assembly in the position as illustrated in FIGS. 1 and 2. The top 20 may then be folded backward to permit access to the opening 42 and the hand extended into the opening and the braces 46 extended outward in the position as shown from the position as shown in FIG. 5 to the position as shown in FIGS. 1 and 2. The longitudinal opening 44 in the front panel may be opened to permit access to the interior of the apparatus and the heater control panel may then be extended upward into the position as shown in FIGS. 1 and 2 and pin 122 inserted in the appropriate one of holes 124. The seat 54 may be adjusted vertically to the proper height for the individual desiring to use the unit. The control panel 104 may also likewise be vertically adjusted.

If dry heat is desired, then the unit is simply plugged in to a suitable source of electrical power, the bather then undresses and seats himself on the seat 54 and closes the front panel by zipper means 44, with his head protruding through the neck opening 42 externally of the chamber 34. The bather then selects the proper temperature setting by means of one of the control buttons 108 and thereafter sets the timer 106 to the proper time interval. If during the time interval, the bather desires to vent the apparatus slightly, he may open the vent opening 50 for that purpose. Upon termination of the selected time interval, the timer 106 will automatically cut off the controls and the heater 86. The bather then opens the front panel and departs from the unit.

The apparatus may be folded up for carrying simply by disconnecting the unit from the electrical power source, folding the control panel 104 downward as shown in the FIG. 5, releasing strap brace 52 and folding the support arms 46 inward as shown in FIG. 2, and thereafter folding the front of panel 10 upward as shown in FIG. 5. Once the front panel has been closed or folded up to the completely closed position, it may be latched in closed position by means of latches 26. The top 20 will be likewise closed and latched into the closed position. The unit then becomes a compact package resembling a suitcase and preferably includes a suitcase-like carrying handle for ease of carrying.

While the present invention has been described and illustrated by means of specific embodiments, it is to be understood that numerous changes and modifications may be made therein without departing from the spirit and scope of the invention as defined in the appended claims.

Having described my invention, I now claim:

1. A collapsible portable hot air and steam bath apparatus, said apparatus comprising:

a substantially rigid box-like body portion having a deep section and a shallow section hinged together along the bottom, said deep section extending vertically for defining a rigid back wall and a portion of two side walls, said shallow section folding downward for defining a floor;

a flexible cover defined by a pair of generally triangular shaped side panels connected along the base thereof to said floor, a sloping rectangular front panel connected at the lower edge thereof to said floor and extending upward to a horizontally extending rectangular top panel connected to the upper end of the back wall and said side walls so that said cover extends from the edges of said section over the opening thereof for defining an enclosable chamber;

a pair of support arms pivotally mounted on the inside of said deep section and extendable outward for supporting said top portion of said flexible cover outward in a horizontal plane;

a neck receiving opening formed in said top portion of said cover;

an elongated opening formed in said front panel extending from said neck opening downward to said floor;

a foldable seat pivotally connected to said back wall and to said floor and opening to a supporting position upon opening said floor panel to the horizontal position;

heating means mounted in said chamber; and control means for controlling said heating means pivotally mounted to said deep section for pivotally extending outwardly to a portion above and to one side of said seat for ease of access by an occupant of said chamber.

2. The bath apparatus of claim 1 wherein:

said control means and said seat are both vertically adjustable with respect to the floor of said apparatus.

3. The bath apparatus of claim 2 wherein:

said heating means is an electrical heater mounted on the bottom wall of said deep section and includes a water tray mounted above the heating element thereof for containing water to be heated into steam by said heating apparatus, and blower means for circulating air within said chamber through said heating apparatus.

4. The bath apparatus of claim 3 wherein:

said deep section includes an upper end panel hinged to the back panel and pivotal backward therefrom providing clearance to the neck opening in the top portion of said cover.

5. The bath apparatus of claim 4 wherein:

said seat assembly includes a rectangular support member defining a seat surface supported on a pair of parallel extending bars, said bars being selectively adjustable vertically in a pair of brackets secured to said back wall, a pair of adjustable length legs pivotally connected at one end to said seat and the opposite end to said front panel and extending upward to support the seat when said front panel is folded downward to define said floor, and back rest means defined by a flexible rectangular panel supported between a pair of laterally spaced vertically extending rods which are pivotally connected at the lower ends to said seat supporting bars and slideably received at their upper end in a pair of grooves in bracket means secured to said back panel.

6. The bath apparatus of claim 5 wherein:

said control means includes a control panel which comprises a control box mounted on one end of a support arm and including timer control means and heat range control means, said arm being pivotally connected at the end of said control panel to bracket means secured to said back panel, said bracket means including a plurality of vertically disposed horizontally extending pin receiving bores and a frictional mounting pin for mounting said end of said arm in selected ones of said vertically arranged holes, and a brace pivotally connected on an outer end to said support arm at a point spaced between the ends thereof and selectively connected at its inner end by pin means in one of selected ones of a plurality of vertically arranged horizontally extending holes in bracket means secured to said back panel.

7. The bath apparatus of claim 6 including:

retractable feet means secured to the bottom panel of said deep section for supporting said section with respect to said front panel when said front panel is extended outward to the horizontal position for defining the floor of said apparatus.

8. The bath apparatus of claim 7 comprising:

vent panel means formed in the front panel of said cover.

9. The bath apparatus of claim 6 wherein:

said box-like body portion is dimensioned and configured to completely enclose said foldable seat assembly, said control panel, said heating means, said support arms, and said flexible cover when said front panel is pivoted upward to a closed position for closing said box-like section.

10. The bath apparatus of claim 9 comprising:

quick release latching means for latching said front panel and said top panel to the closed position, and hand grip means secured externally of one of said side panels for grasping and carrying said assembly when in the closed position.

* * * * *